United States Patent [19]

Nakamura et al.

[11] 4,289,074

[45] Sep. 15, 1981

[54] CONSTRUCTION OF TRUCK FOR ATTRACTIVE TYPE MAGNETICALLY LEVITATED VEHICLE

[75] Inventors: Shinji Nakamura, Kawasaki; Katsuyoshi Yamakawa, Kunitachi, both of Japan

[73] Assignee: Japan Air Lines Co., Ltd., Tokyo, Japan

[21] Appl. No.: 933,038

[22] Filed: Aug. 11, 1978

[30] Foreign Application Priority Data

Sep. 22, 1977 [JP] Japan ..... 52-114058

[51] Int. Cl.[3] ..... B61B 13/08

[52] U.S. Cl. ..... 104/284; 105/157 R

[58] Field of Search ..... 104/148 MS, 23 FS; 105/157 R, 49; 280/788, 794

[56] References Cited

U.S. PATENT DOCUMENTS

| | | | |
|---|---|---|---|
| 2,141,650 | 12/1938 | Harmon et al. | 280/794 |
| 2,457,397 | 12/1948 | Richards | 280/788 |
| 2,836,429 | 5/1958 | Kurka | 280/788 |
| 3,752,246 | 8/1973 | Sullivan | 280/788 |
| 3,937,148 | 2/1976 | Simpson | 104/148 MS |
| 4,029,020 | 6/1977 | Nokamura et al. | 104/148 MS |

FOREIGN PATENT DOCUMENTS

| | | | |
|---|---|---|---|
| 2342734 | 4/1975 | Fed. Rep. of Germany | 104/148 MS |

*Primary Examiner*—John J. Love
*Assistant Examiner*—Ross Weaver
*Attorney, Agent, or Firm*—Wenderoth, Lind & Ponack

[57] ABSTRACT

A truck construction for an attraction type, magnetically levitated vehicle having four electromagnets or electromagnet groups arranged at vertex points in a rectangular plane figure to confront a pair of left and right armature rails laid on the ground. The electromagnets or electromagnet groups are connected to each other by means of girders having a simple structure each constituted by a web and flanges to form a truck having a rectangular plane shape having overall high resistance to torsion. The truck or a group of such trucks are attached to a vehicle through shock absorbing members.

3 Claims, 18 Drawing Figures

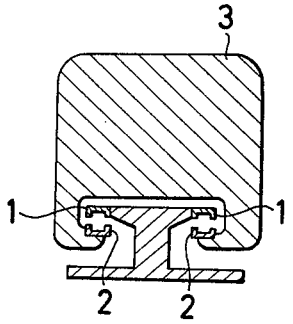
FIG.1a
FIG.1b
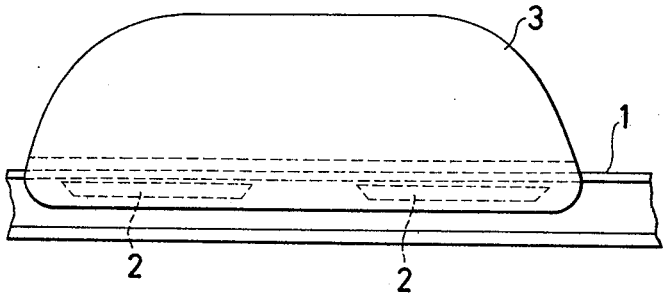

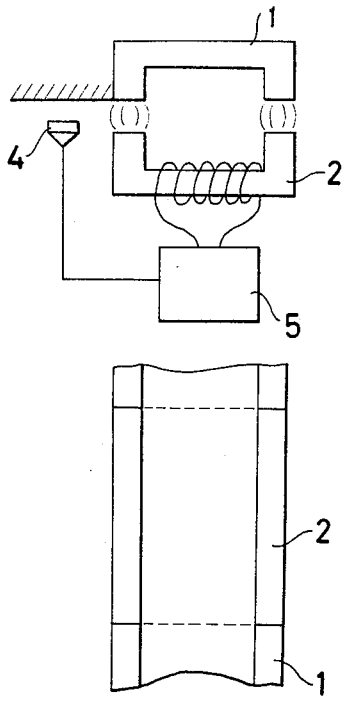
FIG. 2
FIG. 3a
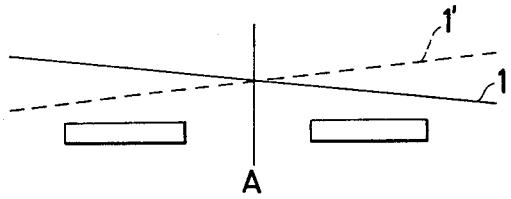
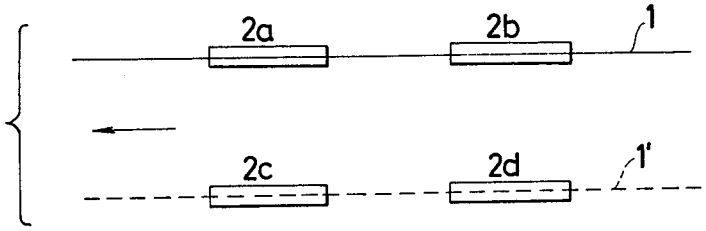
FIG. 3b

CONSTRUCTION OF TRUCK FOR ATTRACTIVE TYPE MAGNETICALLY LEVITATED VEHICLE

BACKGROUND OF THE INVENTION

1. Field of the Invention

This invention relates to the structive of a truck to be used for an attraction type magnetically levitated vehicle.

2. Description of the Prior Art

An attraction type magnetically levitated vehicle is levitated by the action of the attraction between electromagnets (or a group of electromagnets assigned different functions) and armature rails; and, while being guided laterally, is caused to travel by a thrusting power obtained from propelling means separately provided.

In an example of the conventional construction of such a vehicle, which is illustrated in FIGS. 1(*a*) and 1(*b*) of the accompanying drawings, electromagnets 2 having iron cores of a U-shaped cross-section are disposed on the lower part of the vehicle in such a way as to confront a pair of left and right armature rails 1 having also a U-shaped cross-section. The vehicle 3 is levitated when the electromagnets 2 are attracted by the magnetic power toward the armature rails which are made of a ferromagnetic material.

An example in which control means for the exciting power is employed to maintain a preset gap between the armature rails and the electromagnets for stable levitating of the vehicle is as illustrated in FIG. 2. This means for maintaining the preset gap comprises a gap detector 4 which detects the amount of the gap between each confronting pair of an armature rail 1 and an electromagnet 2, and an amplifier 5 which causes a controlled exciting current to flow to the magnet 2 according to variation in the output signal of the gap detector 4. In order to stably levitate a vehicle 3 that has a given length and a given width, four electromagnets 2, each subjected to such exciting power control by the means for maintaining a preset gap, must be disposed at the vertexes of a rectangular plane figure formed by the bottom of the vehicle 3.

The foregoing is the basic constructional arrangement of an attraction type magnetically levitated vehicle. In cases where such a vehicle is to be propelled by a linear motor or the like, the following must be taken into consideration:

The left and right armature rails on the ground preferably have no local uneven surfaces and are laid in parallel with each other in smooth straight lines or curved lines.

Practically speaking, however, it is hardly possible to have the flatness or parallelism of such armature rails above a certain level of precision because of various problems encountered in terms of laying technique and maintenance work. Hence, for running such a vehicle 3, the fact that these armature rails have more or less unevenness must be taken into account. Assuming that four electromagnets 2 provided for levitation are secured directly to a vehicle which is a rigid body, as illustrated in FIGS. 1(*a*) and 1(*b*), there arises two problems. One problem is that if the left and right armature rails 1 and 1 are not perfectly parallel with each other as shown in FIG. 3(*b*), when the vehicle passes the point A shown in FIG. 3*a*, a large electric controlling current for reducing the large gaps flows to each of the electromagnets 2*a* and 2*d* while the electric controlling current flowing to each of the other electromagnets 2*b* and 2*c* decreases to widen the gaps; and this results in the weight of the vehicle being supported chiefly by the electromagnets 2*a* and 2*d*. Then, if the vehicle is stationary at the point A, this tends to bring about overheating of the electromagnets 2*a* and 2*d*. Further, the rotational movement of the vehicle on the electromagnets 2*a* and 2*d* becomes less controllable and, accordingly, the electromagnets 2*b* and 2*c* come closer to the armature rails. Therefore, under such a condition, the electromagnets tend to come into contact with the armature rails due to the shaking of the vehicle that takes place while it is on the run. The other problem relates to the following capability of the electromagnets. Namely, when the vehicle is travelling along uneven rails, the electromagnets must be capable of quickly following vertical displacement of the rails to control and prevent the gaps between the electromagnets and the armature rails from excessively deviating from the preset value. This is very important, particularly in high speed travel, for preventing the electromagnets from coming into contact with the armature rails.

In the case where electromagnets are secured directly to a vehicle as shown in FIG. 1, however, inertia that resists quick movement of the electromagnets is present due to the large mass of the vehicle. In order to enhance the following capability of the electromagnets, therefore, a large amount of controlling power is required. Furthermore, with this configuration, the movement of one electromagnet (or a group of magnets) induces the movement of other electromagnets (or groups of magnets) through the great mass of the vehicle which is a rigid body. In other words, these four electromagnets are dynamically linked with each other. For ideal control over such a system, it is necessary to control the electric current of each electromagnet by a signal which is obtained by mixing signals representing displacements of all electromagnets instead of controlling each electromagnet independently. However, such a control system inevitably becomes complex.

As one method of solving the above stated problems, it is most desirable to have the electromagnets (or groups of electromagnets) connected to the vehicle through shock absorbers which are independently suspended (hereinafter called an "independent suspension system"). Such an arrangement improves the riding quality of the vehicle to a great extent. However, the use of such an independent suspension system in general results in a complex structure with considerable increase in weight. An alternative form of this connection is one in which the four electromagnets (electromagnet groups) are rigidly attached to the truck and the truck is then connected to a vehicle through a shock absorber. Such a method, however, is not only incapable of solving the above stated first problem but also inferior to the independent suspension system which is provided for solving the second problem in terms of controllability and its following capability because of the mass of the rigid truck.

However, if were possible to replace such a rigid truck with a truck having a construction that does not restrict torsion relative to a longitudinal or transverse axis of the truck, the position of the four electromagnets (or electromagnet groups) would no longer be restricted to the same plane. Then, with such an arrangement, almost the same effect as that of the independent suspension system can be achieved. For example, a system can be conceived of which is illustrated in FIGS. 4(*a*) and 4(*b*) wherein a pair of left and right electromagnets 2 in the front part of a vehicle 3 are secured to a rigid body a while another pair of electromagnets 2 in the rear part of the vehicle are also secured to another rigid body b. These rigid bodies a and b are arranged to be rotatable on a longitudinal axis. Then the truck which is arranged in this manner is connected to a vehicle through shock absorbers 7.

In the structural arrangement as illustrated in FIGS. 4(*a*) and 4(*b*), when the position of one electromagnet changes, such a change brings about only a slight pitching movement of the other electromagnets disposed ahead of or after it and only a slight rolling movement of other electromagnets disposed on the left or right side thereof while no vertical positional movement is caused by such a change.

When such arrangement is employed, a preset gap can be easily maintained between the electromagnets and the armature rails even when these rails are not perfectly parallel with each other, thus overcoming the above stated first problem. As for the following cability, since the mass that is involved in the required movement is limited to the electromagnets and the associated structural arrangement, the characteristic can be considerably improved. Furthermore, with this arrangement, the dynamic linkage among these electromagnets is reduced to a great degree, enabling stable control over the levitation of the vehicle.

For this reason, a system having four electromagnets (or groups of electromagnets) disposed on a truck that permits torsional deformation has many advantages as a truck for an attraction type magnetically levitated vehicle. In such a case, however, it is important to note that an electromagnet has an intrinsic property which tends to cause unstable rolling movement in relation to an opposed armature rail. Further, where one electromagnet or even a group of electromagnets is controlled by a gap detector, such an electromagnet or electromagnets also tend to bring about unstable pitching movement in relation to the opposed armature rail. In view of this tendency, such a twistable truck must be designed not to cause such rolling or pitching. The structural arrangement of the truck shown in FIGS. 4(*a*) and 4(*b*) satisfies such conditions.

However, such a design does not permit sufficient reduction in weight because of the mechanical moving parts involved.

SUMMARY OF THE INVENTION

In the following embodiments, the frameworks are made of an aluminum alloy containing 94% Al and 4.5% Cu (JIS 2024-T3).

Accordingly, it is a general object of this invention to provide a structural arrangement of a light weight simple twistable truck which has ordinary simple girder assemblies each consisting of a web portion provided for shearing strength and flanges for bending strength. Such a truck has a high rigidity with respect to bending and shearing forces and yet it has a low torsional rigidity along its axis in the longitudinal direction.

The above and other related objects and features of the invention will be apparent from the following description of examples taken in connection with the accompanying drawings forming a part of this application.

BRIEF DESCRIPTION OF THE DRAWINGS

FIGS. 1(*a*) and 1(*b*) are illustrations of a conventional attraction type magnetically levitated vehicle, FIG. 1(*a*) being a vertical front section and FIG. 1(*b*) a side view of the vehicle;

FIG. 2 is an illustration of means for maintaining a preset gap between each electromagnet and an opposed armature rail;

FIGS. 3(*a*) and 3(*b*) are illustrations representing an uneven state of armature rails, FIG. 3(*a*) being a side view of the rails and FIG. 3(*b*) a plan view;

DETAILED DESCRIPTION OF PREFERRED EMBODIMENTS

Figure 4A:
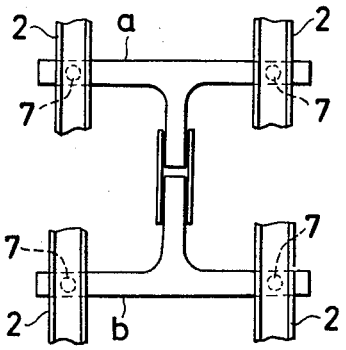
FIGS. 4(*a*) and 4(*b*) are illustrations of the structural arrangement of a truck used for comparison, FIG. 4(*a*) being a plan view and FIG. 4(*b*) a vertical section of a vehicle with the truck attached thereto.
Figure 4B:
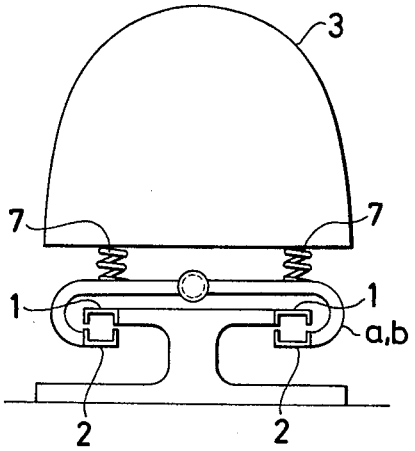
Figure 5A:
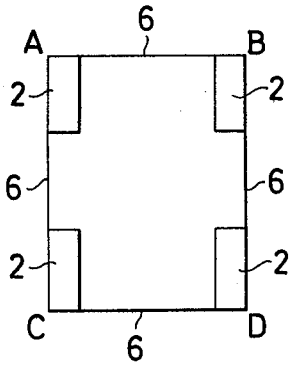
FIGS. 5(*a*) and 5(*b*) illustrate a frame work showing the principle of the present invention, FIG. 5(*a*) being a plan view and FIG. 5(*b*) a perspective view.
Figure 5B:
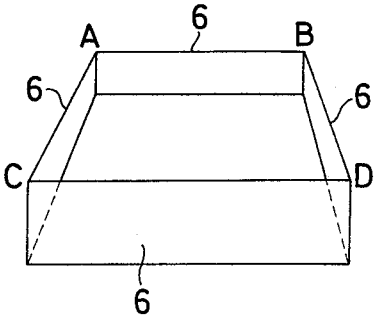
Figure 6A:
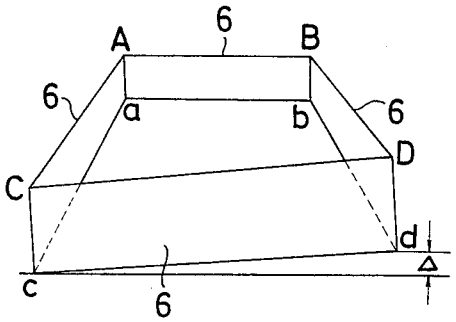
FIGS. 6(*a*) and 6(*b*) are illustrations showing partial distortion of the framework due to torsion, FIG. 6(*a*) being a perspective view and FIG. 6(*b*) a front view.
Figure 6B:
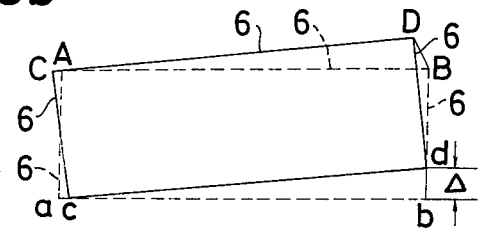

FIGS. 5(*a*) and 5(*b*) and 6(*a*) and 6(*b*) illustrate a framework having a rectangular shape for a truck in accordance with the present invention showing the basic structure and functions thereof. An electromagnet 2 is secured to each vertex portion of the rectangular shape. These electromagnets are attached to a vehicle 3 through shock absorbers (a secondary suspension system). Each side plate 6 of the framework is a girder which has a torsibility as well as rigidity against bending and shearing. With all side plates of the framework in the same horizontal plane, when only one corner d of the four corners is lifted up by an amount Δ, other corners a, b and c are not displaced vertically from the original plane. In other words, the displacement that takes place at the point d is absorbed by the torsional deformation of the four side plates 6 of the framework and does not cause any vertical displacement at the other three points a, b and c. This, therefore, corresponds to a state in which the point d is independently suspended. Exactly the same state also results when displacement takes place at any of the other three corners.

Figure 7:
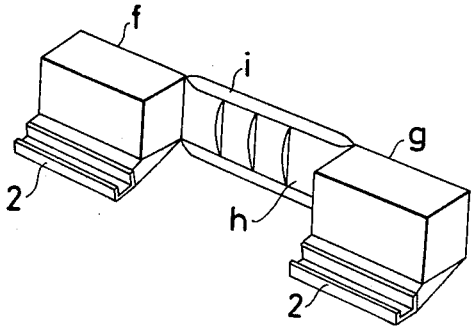
FIG. 7 is a perspective view showing a part of the structural arrangement of a truck according to one example of the invention.
Figure 8:
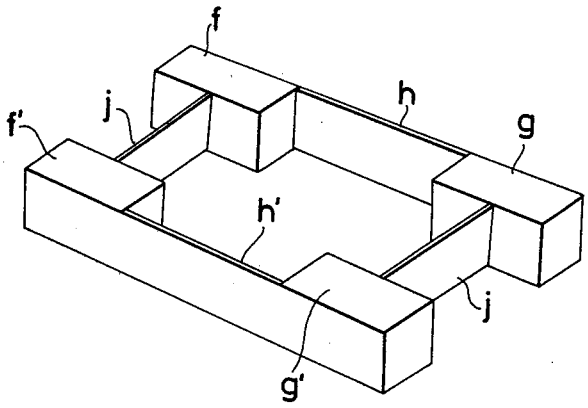
FIG. 8 is a perspective view showing the basic construction of the truck arrangement.

The foregoing roughly explains the principle of the framework which has torsibility. In the actual application of the principle, however, the construction of the truck requires box type rigid supporting bodies which are as light as possible to which heavy electromagnets are securely attached and it also requires a side plate structure which has rigidity against bending and yet which has sufficient torsibility. An example of such a construction is described below:

FIG. 7 shows one side of the framework wherein box bodies f and g are used as supporting rigid bodies to which electromagnets 2 are securely attached; and a girder h which has torsibility and bending rigidity is used to form a side plate of the framework for connecting these boxes f and g to each other. FIG. 8 shows a truck having left and right sides each of which constructed in the above described manner. The left and right sides are connected to each other by means of girders j. For simplification of illustration, the electromagnets are omitted from the illustration in FIG. 8.

Figure 9:
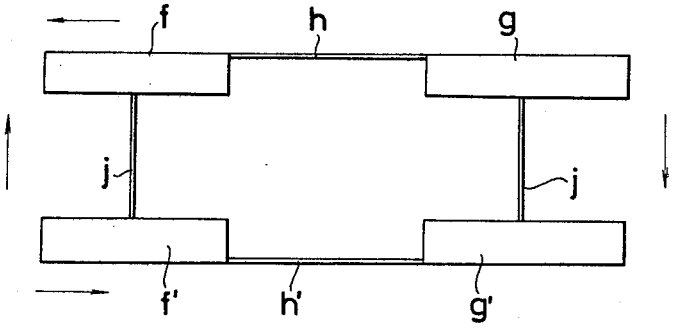
FIG. 9 is a plan view of the truck arrangement of FIG. 8.

The girders j are also constructed to have torsibility while being rigid with respect to bending in the same way as the above described girders h, so that the torsibility of the framework of the truck as a whole is achieved. Such a construction of the truck does not provide sufficient resistance to shearing and bending forces exerted on the whole truck structure within a horizontal plane as indicated by arrows in FIG. 9. It is therefore necessary to add some reinforcement members to impart such a resistance to a sufficient degree while allowing the structure to retain the required torsibility.

Such a reinforcement arrangement is preferably effected by providing light obliquely extending simple tension members. FIGS. 10(*a*) and 10(*b*) show one example of such an arrangement wherein strip-like metal plates or cables k and l are connected to the upper parts of the left and right box bodies in an intercrossed fashion.

Figure 10A:
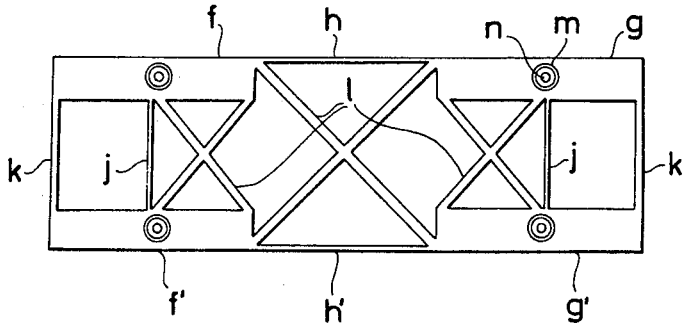
FIGS. 10(*a*) and 10(*b*) are illustrations of the truck arrangement of FIGS. 8 and 9 in which reinforcement members have been added thereto, FIG. 10(*a*) being a plan view and FIG. 10(*b*) a perspective view.
Figure 10B:
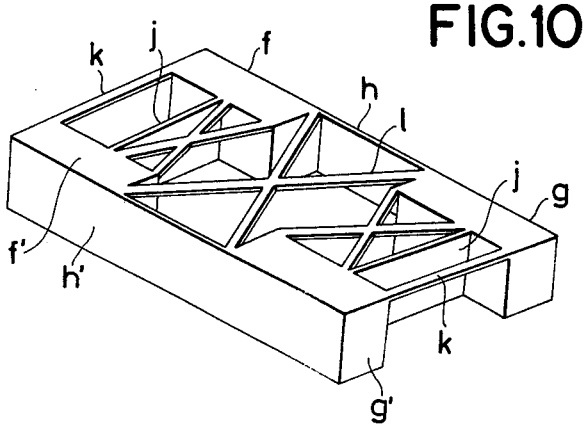

In FIG. 10*a*, reference symbols m and n indicate springs and shock absorbing studs forming shock absorbers which serve as a secondary suspension system.

Figure 11:
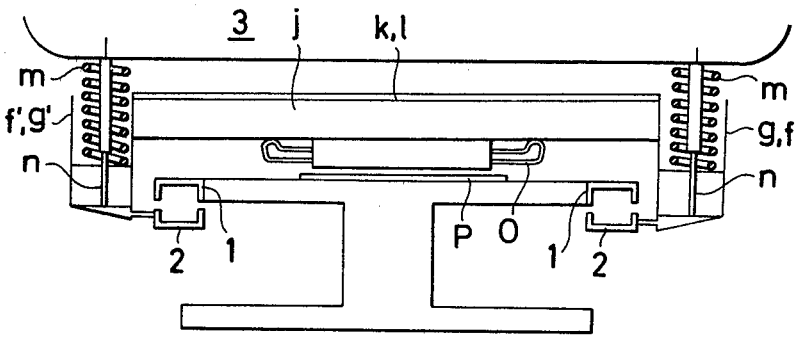
FIG. 11 is a vertical sectional view showing a part of a vehicle combined with the truck.

FIG. 11 shows an attractive type magnetically levitated vehicle which is composed of a truck of the above described construction combined with a vehicle 3 and with a linear motor employed as propelling means. Referring to FIG. 11, box bodies f, f', g and g' are connected to the vehicle 3 by springs m and shock absorbing studs n which serve as secondary suspension members respectively. In the lower part of the truck, there are provided electromagnets 2 securely attached thereto. The reference symbol O indicates a primary side of the linear motor attached to the truck and p indicates a reaction plate on the secondary side of the linear motor arranged on the ground.

Figure 12:
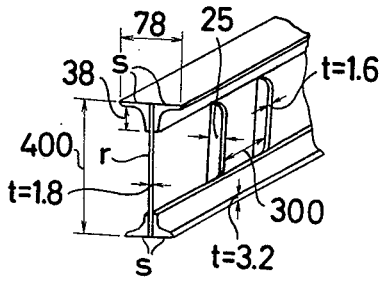
FIG. 12 is a perspective view showing a part of a girder structure.

In FIG. 12, a part of the girder structure according to the present invention is shown with dimensions in mm for individual members, but the present invention is not limited to these numerical values.

The girder structure has a web with flanges S at the top and bottom edge, and laterally projecting reinforcing ribs 25 at intervals along the web.

With the structural arrangement of a truck for an attractive type magnetically levitated vehicle according to the invention, in combination with the secondary suspension system as described in the foregoing, the travelling and stopping operations of the vehicle can be effected without losing an adequate gap between each electromagnet and the corresponding armature rail even in cases where the armature rails are unevenly arranged. In the invented arrangement, the electromagnets have an excellent capability of following the armature rails even under high speed travelling conditions, thereby ensuring improvement in the riding quality of the vehicle. The further advantages of the truck structure according to the invention include simple and light weight construction and reduction in the possibility of breakage.

While the invention has been described in its preferred embodiments wherein only one truck is attached to a vehicle, it is to be understood that the invention is not limited to a single truck system by any of the examples given in the foregoing. In the case of a long vehicle, for example, two or more than two trucks or a group of trucks can be attached to such a vehicle with suitable spacing between them in the longitudinal direction of the vehicle.

What is claimed is:

1. A truck for an attractive type magnetically levitated vehicle which is to be levitated by the attraction of electromagnets, comprising four electromagnet means positioned at the vertex points of a rectangular plane figure for being opposed to a pair of left and right armature rails laid on the ground, and I-beam type girders having a vertical web and horizontal flanges connecting said electromagnet means and extending along the four sides of said rectangular plane figure, said girders being resistive to bending but being sufficiently twistable for permitting said truck as a whole to twist sufficiently for accommodating movement of the magnets out of the plane of said rectangular plane figure to maintain the individual magnets in good magnetic relation to said rails, and shock absorber means at the corners of said rectangular plane figure for attaching said truck to the vehicle.

2. A truck as claimed in claim 1 further comprising tension members extending diagonally across said rectangular plane figure and having the ends connected to portions of said truck, said tension members restricting displacement of said electromagnet means relative to each other when they are subject to shearing forces exerted within said plane rectangular figure while permitting twisting of said truck.

3. A truck as claimed in claim 1 in which said girders comprise a vertical web, horizontal flanges along the top and bottom of said web, and vertically positioned laterally projecting reinforcing projections spaced at intervals along said web.

* * * * *